United States Patent [19]

Haruta et al.

[11] Patent Number: 4,702,216

[45] Date of Patent: Oct. 27, 1987

[54] SYSTEM FOR REDUCING DISCHARGE OF FUEL VAPOR FROM FUEL TANK TO ATMOSPHERE

[75] Inventors: Kazumi Haruta, Obu; Shigeru Yoshida, Toyota, both of Japan

[73] Assignee: Aisan Kogyo Kabushiki Kaisha, Ohbu, Japan

[21] Appl. No.: 927,722

[22] Filed: Nov. 7, 1986

[30] Foreign Application Priority Data

Nov. 8, 1985 [JP] Japan ..... 60-172579[U]

[51] Int. Cl.[4] ..... F02M 33/02

[52] U.S. Cl. ..... 123/520; 123/519

[58] Field of Search ..... 123/516–521

[56] References Cited

U.S. PATENT DOCUMENTS 3,884,204 5/1975 Krautwurst et al. ..... 123/519

FOREIGN PATENT DOCUMENTS 0161952 12/1980 Japan ..... 123/519

*Primary Examiner*—Tony M. Argenbright
*Assistant Examiner*—E. R. Carlberg
*Attorney, Agent, or Firm*—Cushman, Darby & Cushman

[57] ABSTRACT

A system for reducing discharge of fuel vapor from a fuel tank of an internal combustion engine to the atmosphere. The system has only one canister which is connected at one side to a top portion of the tank and to the neck of the refueling opening portion of the tank by separate channels, and which is connected at its other side to a suction system of the engine by a purge channel. The system also has three-way electromagnetic valves which are respectively disposed in the channel connected to the neck of the refueling opening portion and in the purge channel, thereby controlling the flows of fuel vapor and purging air.

1 Claim, 1 Drawing Figure

F I G. I
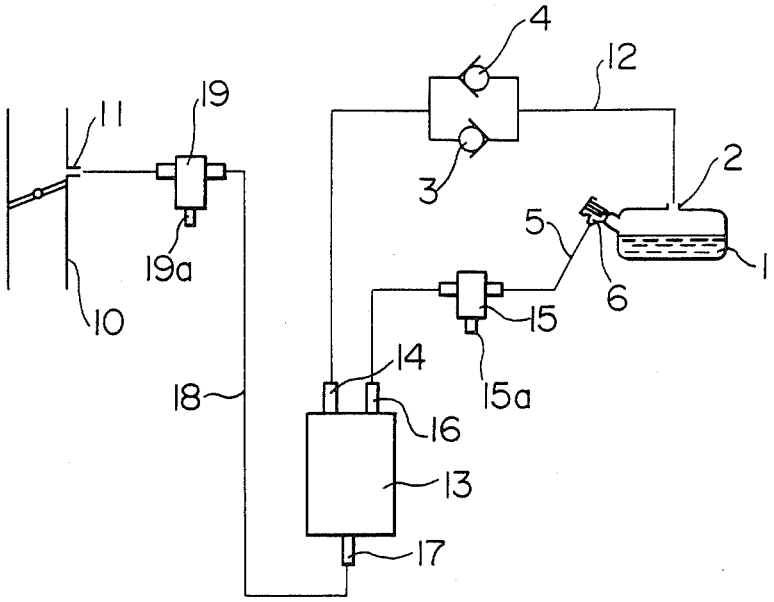

SYSTEM FOR REDUCING DISCHARGE OF FUEL VAPOR FROM FUEL TANK TO ATMOSPHERE

BACKGROUND OF THE INVENTION

This invention relates to a system for preventing the discharge to the atmosphere of fuel vapor generated in a fuel tank for an internal combustion engine.

A kind of system designed to make a canister adsorb fuel vapor generated in a fuel tank for an internal combustion engine of a vehicle or the like and thereafter to extract and supply the adsorbed fuel vapor for the combustion effected by the engine has previously been known, such as that as disclosed in U.S. Pat. No. 3,884,204. This patent was made in consideration of the different states of fuel vapor which can exist, such as that observed when vapor is discharged from the tank during refueling and that observed at other times, and it therefore provides separate canisters for processing accordingly.

It is an object of the present invention to provide a system with a simple construction having only one canister adapted for the different states of fuel vapor being discharged from the tank at the time of refueling and at other times. To this end, the present invention provides a system having a first channel through which fuel vapor passes from the top of a fuel tank to a canister at all the times other than during refueling, a second channel through which fuel vapor passes from the neck of a refueling opening portion of the tank to the canister, a purge channel formed from the canister to a suction channel of the internal combustion engine, a first three-way electromagnetic valve disposed in the second channel, and a second three-way electromagnetic valve disposed in the purge channel, wherein the first electromagnetic valve is operated to open the second channel during the shut-down state of the engine and, during the operation of the engine, to close the channel on the tank side while opening the channel on the canister side to the atmosphere, and wherein the second electromagnetic valve is operated to open the channel on the side of the canister to the atmosphere during the shut-down state of the engine and to open the purge channel during the operation of the engine.

Other and further objects, features and advantages of the invention will appear more fully upon reading the following description.

BRIEF DESCRIPTION OF THE DRAWING

FIG. 1 is a diagram of a fuel vapor flow system which is an embodiment of the present invention.

DESCRIPTION OF THE PREFERRED EMBODIMENT

An embodiment of the present invention will be described with reference to the accompanying drawing.

A vapor outlet port 2 disposed at the top of a fuel tank 1 communicates with a suction port 14 of a canister 13 via a channel 12 and through check valves 3 and 4.

The check valve 3 functions to open when the inside of the tank 1 is heated by a hot external atmosphere such that the internal pressure thereof is increased above a predetermined level during the operation of the engine or the shut-down state of the engine while in a hot atmosphere. The check valve 4 opens when the internal pressure of the tank 1 becomes negative, thereby preventing the deformation of the tank casing. A vapor outlet port 6 formed at the neck of a refueling opening portion communicates with a suction port 16 disposed on one side of the canister 13 via a second channel 5 and through a first three-way changeover electromagnetic valve 15 which is adapted for closing the channel on the tank side and setting the channel to the canister 13 to be communicated with an atmospheric air port 15*a* during the operation of the engine.

A purge port 17 disposed on the other side of the canister 13 communicates with a port 11 open to a suction system 10 of the engine via a purge channel 18 and through a second three-way changeover electromagnetic valve 19.

The second three-way changeover electromagnetic valve 19 is adapted for providing communication between the purge port 17 and the port 11 during the operation of the engine and for providing communication between the purge port 17 and an atmospheric air port 19*a*.

This system functions as follows.

When the pressure of fuel vapor in the tank 1 is increased above a predetermined level during the operating or shut-down state of the engine, this fuel vapor flows into the canister 13 through the tank fuel vapor port 2 and the check valve 3 which is opened, and is adsorbed in the canister. Also fuel vapor forced out during refueling flows into the canister 13 through the fuel vapor port 6 and the first three-way changeover electromagnetic valve 15 and is adsorbed in the canister. The first three-way changeover electromagnetic valve 15 is operated in accordance with the operation of the engine to open the channel on the side of the canister 13 to the atmosphere when the channel on the side of the vapor port 6 is closed. Simultaneously, the second three-way changeover valve 19 provides communication between the canister 13 and the suction system 10 of the engine. Then, in accordance with the operation of the engine, air is introduced into the canister 13 through the first three-way changeover valve 15 while the fuel vapor adsorbed in the canister 13 is introduced into the suction system of the engine by way of the purge channel 18 so as to be supplied to the engine.

The system having only one canister and thus being simply constituted ensures that discharge of fuel vapor generated in the tank to the atmosphere can be adequately reduced and that fuel vapor is effectively utilized for the combustion of the internal combustion engine.

What is claimed is:

1. A system for reducing discharge of fuel vapor from a fuel tank, comprising a first channel through which fuel vapor passes from a tank fuel vapor outlet port formed in the upper wall of said fuel tank to a canister by way of a check valve, a second channel formed from a refueling opening vapor outlet port of said fuel tank to said canister with a first three-way changeover electromagnetic valve disposed therein, a purge channel formed from a purge port of said canister to a suction system of an engine with a second three-way changeover electromagnetic valve disposed therein, wherein said first electromagnetic value is designed to provide communication between said canister and said channel on the side of said refueling opening vapor outlet port during the shut-down state of said engine and, during the operation of said engine, close said channel on the side of said refueling opening vapor outlet port while opening said channel on the side of said canister to the atmosphere, and wherein said second three-way changeover electromagnetic valve is designed to open said channel on the side of said canister to the atmosphere during the shut-down state of said engine and provide communication between said channel on the side of said canister and said suction system of said engine during the operation of said engine.

* * * * *